US006607022B1

(12) United States Patent
Davidson

(10) Patent No.: US 6,607,022 B1
(45) Date of Patent: Aug. 19, 2003

(54) CENTRAL HEATING RADIATORS

(75) Inventor: Paul Anthony Davidson, Macclesfield (GB)

(73) Assignee: Oystertec Plc. (GB)

( * ) Notice: Subject to any disclaimer, the term of this patent is extended or adjusted under 35 U.S.C. 154(b) by 0 days.

(21) Appl. No.: 09/786,592

(22) PCT Filed: Sep. 6, 1999

(86) PCT No.: PCT/GB99/02774

§ 371 (c)(1),
(2), (4) Date: May 31, 2001

(87) PCT Pub. No.: WO00/14453

PCT Pub. Date: Mar. 16, 2000

(30) Foreign Application Priority Data

Sep. 4, 1998 (GB) ..... 9819201

(51) Int. Cl.[7] ..... F28F 7/00; F28F 9/00; F28F 5/00

(52) U.S. Cl. ..... 165/77; 165/86; 165/67

(58) Field of Search ..... 165/77, 86, 178, 165/67, 53; 392/370

(56) References Cited

U.S. PATENT DOCUMENTS

| | | | | | |
|---|---|---|---|---|---|
| 876,714 | A | * | 1/1908 | Harkins et al. | 165/77 |
| 1,154,412 | A | * | 9/1915 | Shailor et al. | 392/370 |
| 3,297,080 | A | * | 1/1967 | Williams et al. | 165/77 |
| 3,561,728 | A | * | 2/1971 | Clarke et al. | 392/370 |

FOREIGN PATENT DOCUMENTS

| | | | | | |
|---|---|---|---|---|---|
| DE | 92 05 889 | U | | 7/1992 | |
| DE | 295 19 417 | U | | 6/1996 | |
| EP | 0777086 | A1 | * | 6/1997 | 165/177 |
| FR | 1 473 430 | A | | 6/1967 | |
| FR | 2486194 | A | * | 6/1981 | |
| FR | 2486194 | A | * | 1/1982 | |
| GB | 2202040 | | * | 9/1988 | |
| GB | 492957A 1 | | * | 1/1992 | 165/53 |
| GB | 2254412 | | * | 7/1992 | 392/370 |

OTHER PUBLICATIONS

International Search Report, International Application No. PCT/GB99/02774.

* cited by examiner

*Primary Examiner*—Henry Bennett
*Assistant Examiner*—Tho V Duong
(74) *Attorney, Agent, or Firm*—Myers Bigel Sibley & Sajovec

(57) ABSTRACT

A central heating radiator assembly comprises a radiator panel (1) having a liquid inlet (25, 7) and liquid outlet (7, 21). Attachment means (29) are for attaching the panel to a wall (27) and pivot means (29) enable the panel to be rotated away from the wall about an upright axis. The invention also provides a method of installing a central heating radiator assembly and a kit of parts for such installation.

26 Claims, 2 Drawing Sheets

CENTRAL HEATING RADIATORS

FIELD OF THE INVENTION

This invention relates to central heating radiators and, more particularly, to the connection of a central heating radiator to its liquid flow and return pipes.

BACKGROUND TO THE INVENTION

Central heating radiators are conventionally mounted adjacent to a wall by hanging them from brackets secured to the wall. The radiator is then plumbed into the heating system by connecting flow and return pipes to apertures in the radiator. The flow and return pipes are usually connected to apertures located at opposite ends of the lower edge of the radiator. Although this minimises the amount of unsightly, exposed pipework, it can cause problems in that water fed to the radiator tends to "short circuit" between the flow and return connections along the lower edge of the radiator, causing poor or uneven heating of the radiator.

Dirt and dust tends to build up in the space between the radiator and the wall as a result of convection currents of air flowing between the radiator and wall when the radiator is in use. This dirt and dust is unsightly and unhygienic and can soil the decoration on the wall around the radiator. However, cleaning the narrow space behind the radiators is difficult. In addition, redecorating the wall behind or around a radiator, or repainting the back of a radiator, is also difficult. In order to remove a radiator to gain access to the wall behind, the flow and return pipes have to be disconnected and reconnected, requiring the services of a plumber. The heating system may also have to be drained.

One solution to this problem has been for radiators to be connected to the flow and return pipes using rotatable connections located at opposite ends of the lower edge of the radiator. This allows a radiator to be moved away from the wall by pivoting it about a horizontal axis near its lower edge. Although access to the wall behind the radiator and to the back of the radiator is thereby allowed, a number of further problems are created. As the radiator is pivoted away from the wall, its weight must be supported to lower it gently to a horizontal position. Radiators are usually made from steel and, when plumbed in and full of water, are heavy. Accordingly the lowering of such radiators is difficult and hazardous. There is a risk that a radiator being lowered could be dropped, possibly injuring the person lowering it and damaging the radiator and plumbing. Also, once the radiator is lowered it still limits access to the wall as it is necessary to lean over the horizontal radiator to reach the wall behind.

STATEMENTS OF THE INVENTION

According to the present invention there is provided a central heating radiator assembly comprising a radiator panel having a liquid inlet with a liquid outlet, means for attaching the panel to a wall, and pivot means for enabling the panel to be rotated away from the wall about an upright axis.

As the radiator remains upright, the user does not need to support its weight in any position. The radiator can therefore be removed easily and safely to gain access to the wall behind it and to the back of the radiator.

The present invention allows a radiator panel to be rotated away from the wall while remaining connected to the heating system. Movement of the radiator can therefore be effected easily and conveniently and the radiator can be operated in any position. Indeed, operating the radiator whilst pivoted away from the wall can increase the output of heat from the radiator. Furthermore the radiator may be in a more accessible position for various uses including the drying of clothes.

As used herein, the term "wall" means any wall, panel or other generally upright surface against which a radiator panel can suitably be located.

Preferably the attachment means comprises the pivot means. In this case, the radiator panel may be attached to the wall by means of both the pivot means and further attachment means. The further attachment means may need to be disconnected to allow the radiator panel to be pivoted away from the wall.

Preferably the liquid inlet and the liquid outlet are located at or near the top and bottom respectively of one side of the radiator panel. Conventionally, liquid flow and return connections to a radiator panel are made to opposite ends of a horizontal edge of a radiator. By arranging the liquid flow to be to and from a common vertical edge of the radiator, a considerable length of pipe may be eliminated, particularly in the case of a radiator of substantial length.

By introducing liquid into the radiator at the top, and exiting liquid from the radiator at the bottom, good circulation of water in the radiator is ensured. Hot water introduced near the top of the panel displaces cooler water towards the bottom resulting in more even heating of the radiator than in the case where the flow and return pipes are connected along the lower edge.

More preferably, the upright axis, about which the radiator panel is rotatable, extends between the liquid inlet and the liquid outlet.

Preferably, the liquid flow means extend between the liquid outlet and the liquid inlet and the liquid outlet includes liquid flow directing means whereby, in use, liquid for entry to the radiator panel flows first to said liquid outlet and is then directed to the liquid inlet.

Preferably, the pivot means is in the form of one or more brackets extending between the wall and said liquid flow means.

A further bracket is preferably provided to support the radiator when adjacent to the wall. The further bracket is preferably arranged to engage with the opposite end of the radiator to that by which the radiator is pivotally mounted.

Preferably, the liquid flow directing means includes means for connection to a flow and return valve, said connection means included rotatable sealing means allowing rotation of the liquid flow directing means relative to said flow and return valve and about said upright axis.

The rotatable sealing means may be in the form of a generally cylindrical plug inserted into one arm of a T-junction connector. This connector is associated with the liquid outlet of the radiator via the leg of the connector. The other arm of the connector extends in a direction towards the liquid inlet. The rotatable sealing means allows essentially the whole of the radiator assembly, including the radiator panel, to be rotated relative to the flow and return valve to which the T-junction connector is connected.

The plug may be an externally threaded member to engage with an internally threaded aperture of the connector. The plug preferably includes an aperture through which two axially disposed pipes may extend, one to carry liquid entering the radiator and the other to carry liquid existing from the radiator. The plug preferably includes a resilient sealing member, such as an O-ring, which forms a seal between the outside of the outer pipe and the inner surface of the plug.

Preferably, the assembly includes a panel support member for supporting the panel when it is in a position rotated away from the wall, the support member being for extension between the panel and the floor.

The present invention also provides a method of installing a central heating radiator assembly including a radiator panel having a liquid inlet and a liquid outlet, the method comprising attaching the panel to a wall and providing pivot means whereby the panel may be rotated away from the wall about an upright access.

Furthermore, the present invention provides a kit of parts for the installation of a central heating radiator panel, the kit comprising at least one bracket to allow the radiator to be rotatably mounted to a wall about an upright axis and liquid flow directing means for directing liquid between a flow and return valve and the radiator panel.

The present invention may be applied to any standard panel radiator using a combination of the brackets allowing the pivotal movement and liquid flow directing means which can be rotatably connected to a standard flow and return valve.

DETAILED DESCRIPTION OF AN EMBODIMENT OF THE INVENTION

An embodiment of the present invention will now be described, by way of example only and with reference to the accompanying drawings.

Figure 1:
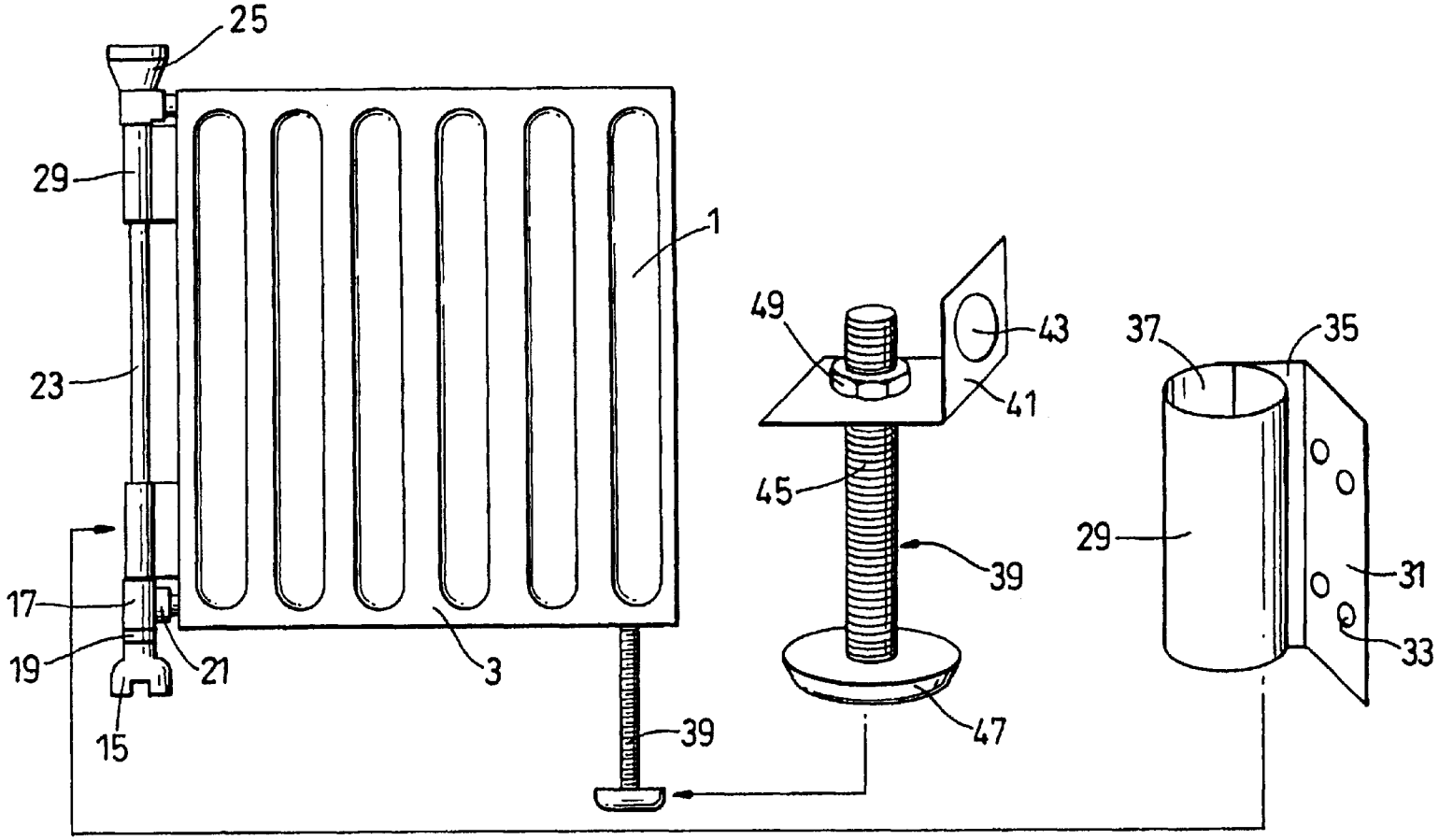
FIG. 1 shows a central heating radiator assembly of the invention with certain parts shown in enlarged detail.

A central heating radiator assembly comprises a radiator panel 1 which, in this case, comprises two sub-panels 3, 5 interconnected by two pairs of upper and lower radiator bosses. Each radiator boss 7 is connected to each panel 3, 5 by means of connecting arms 9. Each boss 7 is also provided with a boss inlet 11. On the right hand side of radiator panel 1, as seen in FIG. 1 the two boss inlets 11 are closed by radiator plugs 13. The bosses on the left hand side of the panel form part of a water inlet for the panel (upper boss) and a water outlet for the panel (lower boss).

Located at the lower left hand corner of panel 1 is a standard flow and return valve 15 by means of which heating water may be led to the panel 1 and water, exiting from panel 1, may be led away from the radiator. Valve 15 is connected to a T-junction connector 17 by means of a plug 19 which provides a rotatable seal and will be described in more detail below.

Use of the present invention is advantageous to home and office builders in the radiator can be metalled after the walls have been decorated, thereby reducing risk of damage to or theft or radiators as well as delaying cash outflow.

The leg 21 of T-junction connector 17 connects with lower left hand boss 7 of panel 1. The upper arm of T-junction connector 17 connects with a steel pipe 23 which extends upwardly from connector 17 to a standard radiator valve 25. This valve 25 connects in turn to upper left hand boss 7 of panel 1.

Radiator panel 1 is mounted on wall 27 (see FIG. 2) by means of upper and lower swivel brackets 29. Each swivel bracket 29 includes a flat plate 31 provided with holes 33 allowing the bracket to be attached to the wall by means of a screw or other fixing. Integral with plate 31 and extending at a right angle from one edge thereof is a further plate 35 which, as illustrated in FIG. 1, curves round on itself to provide a circular cross section, elongate aperture 37 through which pipe 23 loosely extends.

Figure 2:
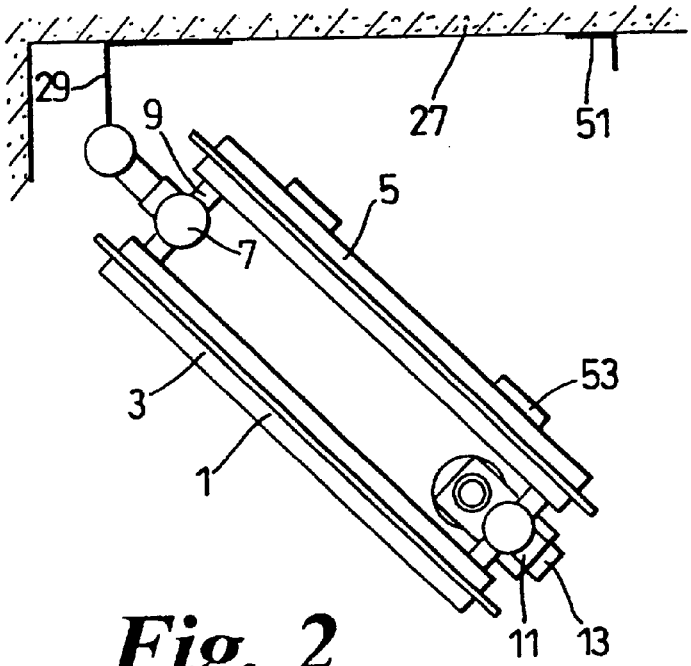
FIG. 2 is a top plan view of the radiator assembly of FIG. 1.

As a result of the use of swivel brackets 29, the radiator panel 1, together with T-junction connector 17, pipe 23 and radiator valve 25, can be rotated about an upright axis extending between T-junction connector 17 and valve 25 and relative to the flow and return valve 15. FIG. 2 shows the position of the radiator assembly when it is rotated through an angle of about 45° away from wall 27.

When the radiator assembly is rotated away from wall 27, as illustrated in FIG. 2, it may be supported at its right hand end (as seen in FIG. 1) by means of support device 39. Device 39 comprises a right-angled bracket 41, each arm of which is provided with a hole 43. Through one of holes 43 there extends a threaded rod 45 having at its lower end a, circular foot member 47. Rod 45 may be raised or lowered relative to bracket 41 by means of hexagon nut 49.

The other limb of bracket 41 is connected, via its hole 43, to lower right hand boss 7 and is held in place by a radiator plug 13.

When the radiator is located in a position away from wall 27, as illustrated in FIG. 2, rod 45 of support device 39 may be lowered until foot member 47 engages with the floor. In this way the radiator panel is supported adjacent its right hand edge.

When the radiator panel 1 is positioned so that it lies adjacent to wall 27, it may be connected to the wall, in addition to the connection via swivel brackets 29, by upper and lower standard radiator brackets 51 which may be connected to, for instance, the left hand bracket attachment members 53 which form standard radiator panel fittings.

Figure 3:
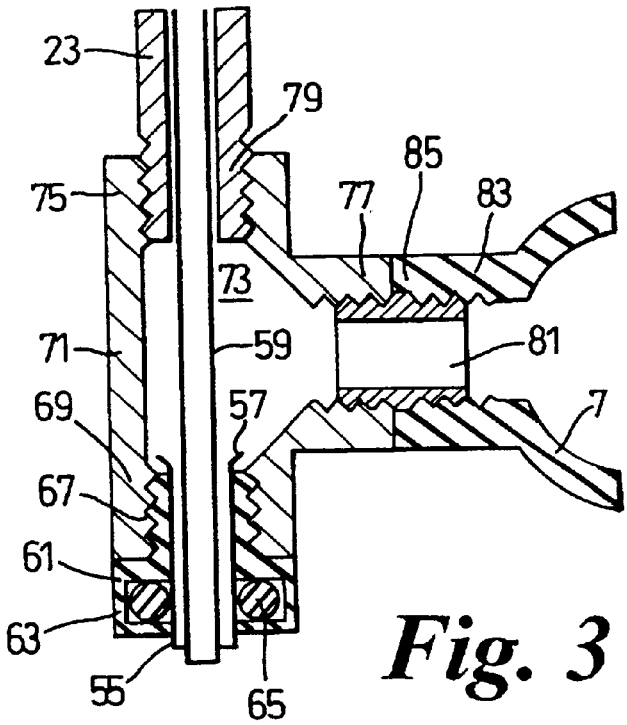
FIG. 3 shows detail of that part of the radiator assembly of FIG. 1 which allows rotation of the panel away from a wall.

Referring to FIG. 3 of the accompanying drawings, there is illustrated in detail that part of the radiator assembly allowing rotation of the assembly about the flow and return valve 15. The flow and return valve 15 (not shown in FIG. 3) is located at the lower end of a short length or "tail" of pipe 55. Tail 55 is provided with an outwardly splayed end 57. Located coaxially within tail 55, and also connected to flow and return valve 15 is a flow pipe 59, made of, for instance, plastics material. In use, flow pipe 59 will carry water which is for entry to the radiator panel 1 and tail 55 will carry water exiting from panel 1.

Surrounding tail 55 is a plug 61 which provides a rotatable seal allowing relative rotation between flow and return valve 15 and the radiator assembly. Plug 61 is of stepped cylindrical shape having a lower, relatively large diameter portion 63 defining a recess within which is located an O-ring 65. This sealing member provides sealing between the inner surface of plug 61 and the outer surface of tail 55.

Extending upwardly from portion 63 of plug 61, and integral therewith, is a relatively small diameter portion 67 which is threaded on its outer surface. This portion 67 extends between relatively large diameter portion 63 and the splayed-out end 57 of tail 55.

Threadedly engaged with threaded portion 67 of plug 61 is one arm 69 of T-junction connector 71. Connector 71 defines central space 73 which is in fluid connection with arm 69, opposite arm 75 and leg 77 of the connector. Arm 75 is threaded on its inner surface and threadedly engaged within arm 75 is the threaded end portion 79 of steel pipe 23 which extends upwardly to valve 25 (see FIG. 1).

Leg 77 is connected to radiator boss 7 by means of a running nipple 81. Running nipple 81 is threaded along its entire outer surface and is threadedly engaged with leg 77 of connector 71 along approximately half its length. The other half of running nipple 81 is threadedly engaged with arm 83 of boss 7, this arm having an inner threaded surface.

A rubber joint 85 is provided between the radial end surfaces of leg 77 of connector 71 and arm 83 of boss 7. This joint 81 provides a water-tight seal between boss 7 and connector 71.

The above described arrangement shown in FIG. 3 allows the whole radiator assembly to turn on the plug 63 and tail 55. Flow pipe 59 creates a surge of water upwards through connector 71 and past the exit point of the radiator panel provided by boss 7. Exiting water passing out of boss 7 into space 73 of connector 71 proceeds downwardly between tail 55 and flow pipe 59 into the flow and return pipe 15.

In an alternative embodiment the two swivel brackets 29 are replaced by a single swivel bracket which extends from the underside of valve 25 to the top of connector 17. However, the use of two swivel brackets allows the same brackets to be used in connection with different radiator systems where the distance between valve 25 and connector 17 may vary.

What is claimed is:

1. A central heating radiator assembly comprising a radiator panel having a liquid inlet and, vertically separated therefrom, a liquid outlet, a unitary flow and return valve and liquid flow directing means interconnecting the unitary flow and return valve and each of said liquid inlet and said liquid outlet, wherein the assembly further includes rotatable sealing means, located between said unitary flow and return valve and said liquid flow directing means, allowing rotation of the liquid flow directing means and said radiator panel relative to said unitary flow and return valve and about an upright axis interconnecting said liquid inlet and said liquid outlet, said unitary flow and return valve being stationary and said radiator panel and said flow directing means rotating relative thereto the assembly also including pivot means enabling the panel to be rotated away from a wall about said upright axis.

2. An assembly according to claim 1 wherein the liquid inlet and the liquid outlet are located at or near the top and bottom respectively of one side of the radiator panel.

3. An assembly according to claim 1 or claim 2 wherein said pivot means is in the form of one or more brackets extending between the wall and the radiator assembly.

4. An assembly according to claim 1 wherein the assembly includes a panel support member for supporting the panel when it is in a position rotated away from the wall, the support member extending between the panel and a floor.

5. A central heating radiator assembly according to claim 1 wherein the rotatable sealing means is in the form of a generally cylindrical plug.

6. An assembly according to claim 5 wherein the plug comprises an externally threaded member for connection with the liquid flow directing means.

7. An assembly according to claim 5 wherein the plug includes an aperture through which two axially disposed pipes extend, one of said axially disposed pipes to carry liquid entering the radiator and the other said axially disposed pipes to carry liquid exiting from the radiator.

8. An assembly according to claim 7 wherein the plug includes a resilient sealing member to form a seal between the outside of the outermost of said axially disposed pipes and the inner surface of the plug.

9. An assembly according to claim 1 wherein the liquid flow directing means comprises a T-junction connector having a leg and two arms having inserted therein said rotatable sealing means and said leg of said T-junction connector connecting with said liquid outlet, the other of said arms extending in a direction towards said liquid inlet.

10. An assembly according to claim 1, wherein the liquid flow directing means is an independent component from said radiator panel.

11. A central heating radiator assembly comprising a radiator panel having a liquid inlet and, vertically separated therefrom, a liquid outlet, a flow and return valve and liquid flow directing means interconnecting the flow and return valve and each of said liquid inlet and said liquid outlet, wherein the assembly further includes roatable sealing means, located between said flow and return valve and said flow directing means, allowing rotation of the liquid flow directing means relative to said flow and return valve and about an upright axis interconnecting said liquid inlet and said liquid outlet, the assembly also including pivot means enabling the panel to be rotated away from a wall about said upright axis wherein the rotatable sealing means is in the form of a generally cylindrical plug, wherein the plug includes an aperture through which two axially disposed pipes extend, one of said axially disposed pipes to carry liquid entering the radiator and the other said axially disposed pipes to carry liquid exiting from the radiator.

12. An assembly according to claim 11, wherein the liquid inlet and the liquid outlet are located at or near the top and bottom respectively of one side of the radiator panel.

13. An assembly according to claim 11, wherein said pivot means is in the form of one or more brackets extending between a wall and the radiator assembly.

14. An assembly according to claim 11, further comprising a panel support member for supporting the panel when it is in a position rotated away from a wall, the support member extending between the panel and a floor.

15. An assembly according to claim 11, wherein the plug includes a resilient sealing member to form a seal between the outside of the outermost of said axially disposed pipes and the inner surface of the plug.

16. An assembly according to claim 11, wherein the plug comprises an externally threaded member for connection with the liquid flow directing means.

17. A central heating radiator assembly comprising a radiator panel having a liquid inlet and, vertically separated therefrom, a liquid outlet, a flow and return valve and liquid flow directing means interconnecting the flow and return valve and each of said liquid inlet and said liquid outlet, wherein the assembly further includes rotatable sealing means, located between said flow and return valve and said flow directing means, allowing rotation of the liquid flow directing means relative to said flow and return valve and about an upright axis interconnecting said liquid inlet and said liquid outlet and wherein the liquid flow directing means comprises a T-junction connector having a leg and two arms having inserted therein said rotatable sealing means and said leg of said T-junction connector connecting with said liquid outlet, the other of said arms extending in a direction towards said liquid inlet.

18. An assembly according to claim 17, wherein the liquid inlet and the liquid outlet are located at or near the top and bottom respectively of one side of the radiator panel.

19. An assembly according to claim 17, wherein said pivot means is in the form of one or more brackets extending between a wall and the radiator assembly.

20. An assembly according to claim 17, further comprising a panel support member for supporting the panel when it is in a position rotated away from a wall, the support member extending between the panel and a floor.

21. An assembly according to claim 17, wherein the plug includes a resilient sealing member to form a seal between the outside of the outermost of said axially disposed pipes and the inner surface of the plug.

22. An assembly according to claim 17, wherein the plug comprises an externally threaded member for connection with the liquid flow directing means.

23. An assembly according to claim 17, further comprising pivot means enabling the panel to be rotated away from a wall about said upright axis wherein the rotatable sealing means is in the form of a generally cylindrical plug.

24. An assembly according to claim 17, wherein the plug includes an aperture through which two axially disposed pipes extend, one of said axially disposed pipes to carry liquid entering the radiator and the other said axially disposed pipes to carry liquid exiting from the radiator.

25. A method of installing a central heating radiator assembly having a radiator panel, a liquid inlet and, vertically separated therefrom, a liquid outlet, a unitary flow and return valve and liquid flow directing means interconnecting the unitary flow and return valve and each of said liquid inlet and said liquid outlet, wherein the method includes the steps of: locating between said unitary flow and return valve and said flow directing means rotatable sealing means allowing rotation of the liquid flow directing means and said radiator panel relative to said unitary flow and return valve and about an upright axis interconnecting said liquid inlet and said liquid outlet said unitary flow and return valve being made stationary such that said radiator panel and said flow directing means are able to rotate relative thereto; and providing pivot means to enable the panel to be rotated away from a wall about said upright axis.

26. A kit of parts for installation of a central heating radiator assembly, the assembly including a radiator panel having a liquid inlet and, vertically separated therefrom, a liquid outlet, a unitary flow and return valve, the kit comprising a liquid flow directing means interconnecting the unitary flow and return valve and each of said liquid inlet and said liquid outlet, wherein the kit comprises pivot means to allow the radiator panel to be rotatably mounted to a wall about an upright axis and rotatable sealing means for location between said unitary flow and return valve and said liquid flow directing means, said rotatable sealing means allowing rotation of the liquid flow directing means and said radiator panel relative to said unitary flow and return valve and about an upright axis interconnecting said liquid inlet and said liquid outlet.

* * * * *

UNITED STATES PATENT AND TRADEMARK OFFICE

CERTIFICATE OF CORRECTION

PATENT NO. : 6,607,022 B1
DATED : August 19, 2003
INVENTOR(S) : Davidson

It is certified that error appears in the above-identified patent and that said Letters Patent is hereby corrected as shown below:

Title page,
Item [57], ABSTRACT, please replace with the following:
-- A central heating radiator assembly includes a radiator panel having a liquid inlet and, vertically separated therefrom, a liquid outlet, a flow and return valve and liquid flow directing means interconnecting the flow and return valve and each of the liquid inlet and liquid outlet. The assembly is characterized in that it further includes rotatable sealing means, located between the flow and return valve and the flow directing means, allowing rotation of the liquid flow directing means relative to the flow and return valve and about an upright axis interconnecting the liquid inlet and the liquid outlet. The assembly also includes pivot means enabling the panel to be rotated away from the wall about the upright axis. --

Column 5,
Line 46, should read -- 3. An assembly according to claim 1 wherein --

Signed and Sealed this

Eighteenth Day of May, 2004

JON W. DUDAS
*Acting Director of the United States Patent and Trademark Office*